US008145098B2

(12) United States Patent
Seorl et al.

(10) Patent No.: US 8,145,098 B2
(45) Date of Patent: Mar. 27, 2012

(54) IMAGE FORMING APPARATUS INCLUDING SHUTTER DEVICE

(75) Inventors: Kwoang Joe Seorl, Yongin-Si (KR); Myoung Sub Jang, Suweon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 577 days.

(21) Appl. No.: 12/332,637

(22) Filed: Dec. 11, 2008

(65) Prior Publication Data

US 2009/0175649 A1 Jul. 9, 2009

(30) Foreign Application Priority Data

Jan. 8, 2008 (KR) ..... 10-2008-0002167

(51) Int. Cl.
*G03G 15/04* (2006.01)

(52) U.S. Cl. ..... 399/177; 399/51

(58) Field of Classification Search ..... 399/51, 399/177; 347/224, 241
See application file for complete search history.

(56) References Cited

U.S. PATENT DOCUMENTS

2004/0240905 A1* 12/2004 Yamazaki ..... 399/98
2005/0089315 A1* 4/2005 Imamura et al. ..... 386/127
2005/0094217 A1 5/2005 Molchan et al.
2006/0177237 A1 8/2006 Kim et al.
2007/0020016 A1* 1/2007 Nakamura et al. ..... 400/691
2007/0070173 A1* 3/2007 Yamakawa et al. ..... 347/241
2008/0193163 A1* 8/2008 Moon et al. ..... 399/128
2010/0046979 A1* 2/2010 Lee et al. ..... 399/90

FOREIGN PATENT DOCUMENTS

CN 1577143 2/2005
JP 2000-263839 9/2000
KR 10-2005-110224 11/2005

OTHER PUBLICATIONS

English language abstract of KR 10-2005-110224, published Nov. 23, 2005.
European Search Report issued in European Application No. 08158937.6 mailed Nov. 12, 2008.
Office Action issued in Chinese Application No. 200810131809.2, mailed Jan. 15, 2010.
English language translation of Office Action issued in Chinese Application No. 200810131809.2, mailed Jan. 15, 2010.
English language abstract of CN 1577143, published Feb. 9, 2005.
English language abstract of JP 2000-263839, published Sep. 26, 2008.
Machine English language translation of JP 2000-263839, published Sep. 26, 2008.

* cited by examiner

*Primary Examiner* — David Gray
*Assistant Examiner* — G. M. Hyder
(74) *Attorney, Agent, or Firm* — Stanzione & Kim, LLP

(57) ABSTRACT

An image forming apparatus disclosed includes a body, a cover to open and close an opening of the body, a plurality of photosensitive members provided in the body, a light scanning device to irradiate a light beam to the plurality of photosensitive members, the light scanning device including a plurality of passage windows corresponding to the plurality of photosensitive members, and a shutter device to open and close the respective passage windows in accordance with opening and closing movements of the cover.

19 Claims, 8 Drawing Sheets

IMAGE FORMING APPARATUS INCLUDING SHUTTER DEVICE

CROSS-REFERENCE TO RELATED APPLICATION

This application claims the benefit of Korean Patent Application No. 2008-0002167, filed on Jan. 8, 2008 in the Korean Intellectual Property Office, the disclosure of which is incorporated herein by reference.

BACKGROUND OF THE INVENTION

1. Field of the Invention

The present invention relates to an image forming apparatus, and, more particularly, to a color image forming apparatus, which includes a plurality of photosensitive members, upon each of which is formed a visible image, whereby a visible color image can be formed by overlapping visible images of different colors formed on the respective photosensitive members.

2. Description of the Related Art

In general, an image forming apparatus is an apparatus to develop a black-and-white image or color image on a printing medium, such as paper, according to an image signal. Examples of the image forming apparatus include laser printers, inkjet printers, copiers, facsimiles, and devices performing various combination of functions thereof. Representative image forming methods of these various image forming apparatuses include an electro-photographic method, in which an electrostatic latent image is formed on a photosensitive member via irradiation of light beam, and in which the electrostatic latent image is developed with developer and transferred onto a printing medium, and an inkjet method, in which liquid-phase ink is ejected onto a printing medium surface according to an image signal.

In an electro-photographic image forming apparatus, after charging a photosensitive member surface with a predetermined electric potential, a light beam is irradiated onto the photosensitive member, to form an electrostatic latent image by potential difference between those portions that have been irradiated and those that have not. A developer is applied to the electrostatic latent image, to form a visible image. After the visible image, formed on the photosensitive member, is transferred to a printing medium, heat and pressure are applied to the printing medium, to fix the visible image, of, e.g., powder developer, on the surface of the printing medium. In such manner, an image is recorded on a printing medium.

Broadly speaking, an electro-photographic image forming apparatus could be a monochromatic image forming apparatus to print a black-and-white image and/or a color image forming apparatus capable of printing a color image.

A color image forming apparatus is classified into a so-called multi-path type color image forming apparatus having a single photosensitive member, and a so-called single-path type color image forming apparatus having a plurality of photosensitive members corresponding to the number of developing units of different colors.

In a multi-path type color image forming apparatus, only one developing unit is operated during one revolution of the single photosensitive member, forming a single color visible image on the photosensitive member. The visible image formed on the photosensitive member is transferred before another developing unit of different color is operated. Thus, a multi-path type color image forming apparatus may be equipped with a single photosensitive member and a single light scanning device.

In a single-path type color image forming apparatus, on the other hand, different colors of visible images are sequentially formed, sometimes with a slight time difference, on the respective ones of the photosensitive members corresponding to each of the developing units. A light scanning device in a single-path type color image forming apparatus may be formed with a plurality of light passage windows corresponding to the respective photosensitive members.

When the light passage window(s) becomes contaminated with debris, for example, toner or dust particles or dirt, etc., the image quality may be adversely affected. The likelihood of such contamination increases with the increased number of light passage windows, e.g., in the case of a single-path type color image forming apparatus.

An attempt to prevent toner or dirt from a developing unit from contaminating the optical parts of a light scanning device is disclosed by Japanese Patent Laid-Open Publication No. 2000-0263839 to Susumu ("Susumu"). Susumu discloses an image forming apparatus that includes a plurality of laser beam passage windows each facing a photosensitive member, a shutter to block the passage window, a shutter mover, and a laser beam passage formed on the shutter so as to be located on an optical path of a laser beam within a movement range of the shutter, the laser beam passage located so as to be not below a developing point of the photosensitive member. The shutter is divided into a shutter for black, and a shutter for chromatic colors, which are operated independently.

However, the image forming apparatus of Susumu requires a separate drive motor to drive the shutter, and suffers from increased manufacturing costs and/or size of the image forming apparatus in order to provide a space for the drive motor.

Moreover, in the image forming apparatus disclosed by Susumu the shutter moves along a single common plane, and if the plurality of light passage windows are not likewise arranged on a single plane, there may be gaps between some of the plurality of light passage windows and the shutter. These gaps may lessen the effectiveness of the shutters in preventing contaminations of the passage windows, and are wasted dead spaces contributing to a poor space utilization.

BRIEF DESCRIPTION OF THE DRAWINGS

Various aspects and advantages of the embodiments of the invention will become apparent and more readily appreciated from the following description of the embodiments, taken in conjunction with the accompanying drawings, of which.

DETAILED DESCRIPTION OF SEVERAL EMBODIMENTS

Figure 1:
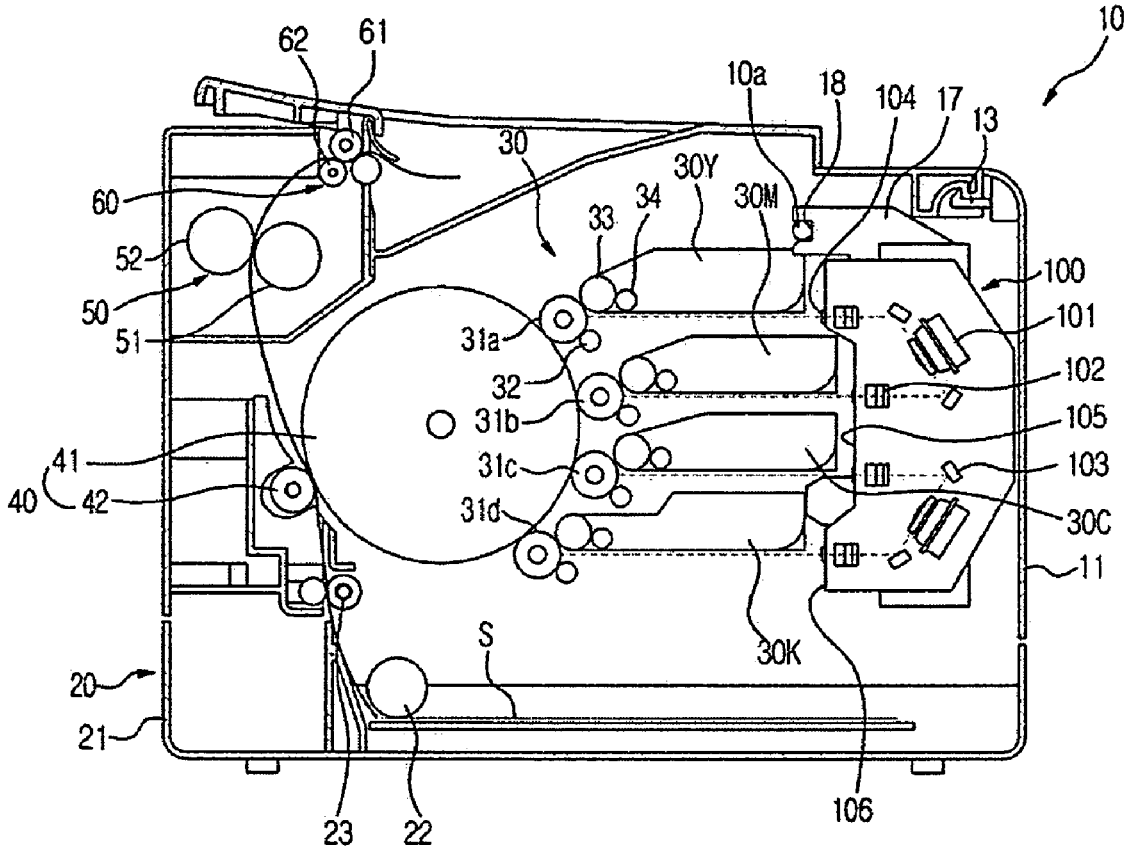
FIG. 1 is a sectional view illustrating the configuration of an image forming apparatus in accordance with a first embodiment of the present invention.

Reference will now be made in detail to exemplary embodiments of the present invention, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be noted that in the drawings, the dimensions of the features are not intended to be to true scale, and may be exaggerated for the sake of allowing greater understanding.

FIG. 1 is a sectional view illustrating the configuration of an image forming apparatus in accordance with a first embodiment of the present invention.

The image forming apparatus in accordance with the embodiment is a so-called single path type color image forming apparatus, which includes a plurality of photosensitive members, on which different colors (for example, magenta, cyan, yellow, and black) of visible images are respectively formed, whereby the visible images formed on the respective photosensitive members are overlapped with one another, to form a color image.

The image forming apparatus in accordance with the first embodiment of the present invention, as shown in FIG. 1, may include a body 10, a paper supply device 20, a developing device 30, a light scanning device 100, a transfer device 40, a fixing device 50, and a paper discharge device 60.

The body 10 defines the external appearance of the image forming apparatus, and supports therein a variety of elements.

The paper supply device 20 serves to supply paper S as a printing medium to the transfer device 40. The paper supply device 20 may include a paper supply tray 21, on which the paper S is loaded, a pickup roller 22 to pick up the paper S loaded on the paper supply tray 21 sheet by sheet, and a delivery roller 23 to deliver the picked-up printing medium to the transfer device 40.

Accordingly, the paper S loaded in the paper supply tray 21 is picked up sheet by sheet by the pickup roller 22, and the picked-up paper is delivered to the transfer device 40 by the delivery roller 23.

The developing device 30 may be composed of four developing units 30Y, 30M, 30C, and 30K, which receive different colors of toners, for example, yellow toner Y, magenta toner M, cyan toner C, and black toner K, respectively. It should be understood that while by way of an example four developing units are included on this embodiment, any number of developing units may be provided as needed in a particular design or application.

Each of the developing units 30Y, 30M, 30C, and 30K may include a photosensitive member 31 (i.e., respective one of 31*a*, 31*b*, 31*c* and 31*d*), having a surface on which an electrostatic latent image is formed via operation of the light scanning device 100, a charge roller 32 to charge the photosensitive member 31, a developing roller 33 to develop the electrostatic latent image formed on the photosensitive member 31 into a toner image, and a supply roller 34 to supply the toner to the developing roller 33.

The light scanning device 100 serves to irradiate light, e.g., a laser beam, corresponding to image information of yellow, magenta, cyan and black, to the respective photosensitive member 31 of the developing unit according to the image to be printed, so as to form the electrostatic latent image. The light scanning device 100 may include a light source (not shown) producing the laser beam, polygonal mirrors 101 to deflect the laser beam within a predetermined angular range, F-theta lenses 102 to scan the laser beam toward the photosensitive member at a constant speed, and reflective mirrors 103.

The polygonal mirrors 101 serve to reflect the light irradiated from the light source in a scanning direction of a desired angle. The reflective mirrors 103 serve to reflect the light reflected from the polygonal mirrors 101 toward the F-theta lenses 102. The F-theta lenses 102 are installed on optical paths of the light reflected from the reflective mirrors 103 and serve to regulate the focus of the light. The scanning light, having passed through the F-theta lenses 102, is finally directed to the photosensitive members 31 through passage windows 104. The light scanning device 100 will be described in more detail later.

The transfer device 40 may include an intermediate transfer drum 41, and a transfer roller 42 to transfer a color image formed on the intermediate transfer drum 41 to a printing medium.

Different colors of visible images, which are formed on the respective photosensitive members 31, are sequentially transferred to the intermediate transfer drum 41, so as to overlap one another, forming a color image. The transfer roller 42 serves to transfer the color image formed on the intermediate transfer drum 41 to a surface of the printing medium. Specifically, when the printing medium passes through a gap between the intermediate transfer drum 41 and the transfer roller 42, the color image is transferred to the surface of the printing medium.

The fixing device 50 serves to fix the image transferred to the paper by applying heat and/or pressure to the image. The fixing device 50 may include a heating roller 51 having a heating source to apply heat to the paper on which the image was transferred, and a pressure roller 52 to be pressed against the heating roller 51 with a predetermined pressure.

The paper discharge device 60 serves to discharge the paper, on which the image is completely printed, to the outside of the body 10. The paper discharge device 60 includes a paper discharge roller 61, and a paper backup roller 62 installed opposite the paper discharge roller 61.

In an image forming apparatus of the above-described embodiment, at the beginning of a printing operation, the pickup roller 22 is operated to pick up printing media, loaded in the paper supply tray 21, sheet by sheet. Although the pickup roller 22 is rotatably installed at a fixed position, it can successively pick up a plurality of printing media loaded in the paper supply tray 21 because the paper supply tray 21 moves the printing media upward to the pickup roller 22. After picking up, the pickup roller 22 delivers the picked-up printing medium to the delivery roller 23, the delivery roller 23 delivers the printing medium toward the transfer device 40 after aligning the leading end of the printing medium.

The charge rollers 32, located close to the respective photosensitive members 31 charge the surfaces of the photosensitive members 31 with a predetermined electric potential. The light scanning device 100 irradiates beams to the respective photosensitive members 31 according to an image signal, forming electrostatic latent images on the surfaces of the photosensitive members 31.

After the electrostatic latent images are formed on the respective photosensitive members 31, different colors (for example, magenta, cyan, yellow, black) of toners (i.e. developers) of the respective developing units 30Y, 30M, 30C, and 30K are attached to the respective photosensitive members 31, forming visible images of different colors. The visible images are sequentially transferred to the intermediate transfer drum 41 in a manner overlapping one another to form a color image on the intermediate transfer drum 41.

The color image is transferred from the intermediate transfer drum 41 to the surface of the printing medium when the printing medium passes through the gap between the intermediate transfer drum 41 and the transfer roller 42. Then, the printing medium, to which the color image was transferred, is delivered to the fixing device 50, which applies heat and pressure to the printing medium, allowing the color image composed of toner to be melted and fixed to the surface of the printing medium.

The printing medium, having passed through the fixing device 50, is discharged out of the body 10 via operation of the paper discharge device 60.

Figure 2:
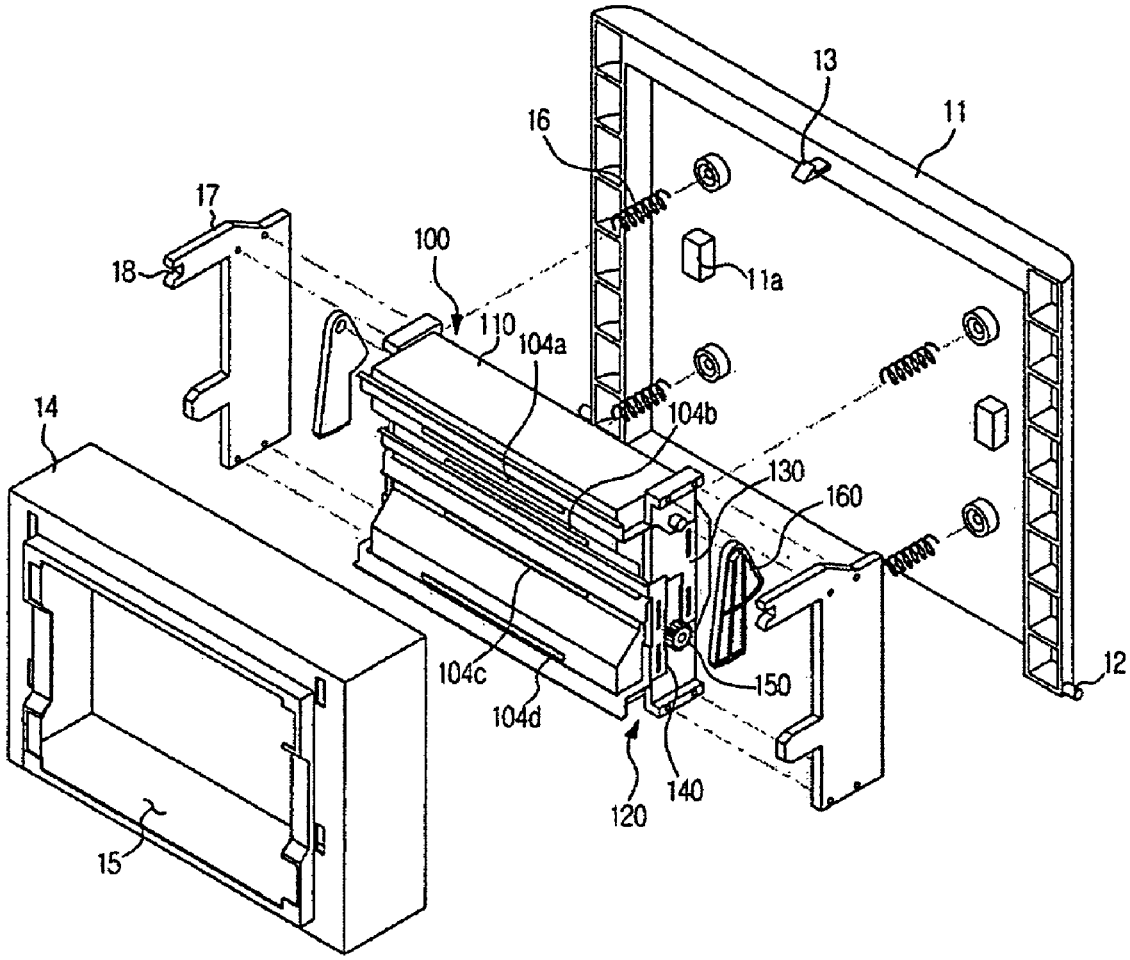
FIG. 2 is an exploded perspective view illustrating a cover and a light scanning device provided in the image forming apparatus in accordance with the first embodiment of the present invention.

FIG. 2 is an exploded perspective view illustrating a cover and a light scanning unit provided in the image forming apparatus in accordance with the first embodiment of the present invention.

The image forming apparatus in accordance with the first embodiment of the present invention, as shown in FIGS. 1 and 2, includes a cover 11 pivotally and rotatably coupled to the body 10 to open and close an opening formed on the front face of the body 10, and a shutter device 120 to open or close the passage windows 104 (104*a*, 104*b*, 104*c*, and 104*d*) of the light scanning device 100 supported on the cover 11.

The cover 11 is provided to be selectively open so as to allow an access into the body 10 when, e.g., it is desired to change consumables in the body 10 such as the developing units, etc., or to remove a jammed printing medium.

Hinges 12 are formed at the lower end of the cover 11, to allow the cover 11 to be pivotally rotated up and down about the hinges 12, so as to open and close the front side of the body 10.

A hook 13 may be formed at the center of an upper end of a rear surface of the cover 11 to engage with a portion of the body 10 to retain the cover 11 in a closed position. A pusher (not shown) or the like may be formed at an upper end of a front surface of the cover 11 to allow a user to operate the hook 13. Any known structures and operations for the hook 13 and the pusher for opening or closing of the cover 11 may be used, the detailed descriptions thereof thus are not necessary.

A fixing member 14 is provided on the rear surface of the cover 11, to support the light scanning device 100 in place. The light scanning device 100 may be disposed inside the fixing member 14 in such a manner to allow a slight movement of the light scanning device 100 toward or away from the cover 11. The fixing member 14 has an opening 15 formed at the front surface thereof to expose the passage windows 104 of the light scanning device 100.

The light scanning device 100 includes a case 110, and the polygonal mirrors 101, F-theta lenses 102 and reflective mirrors 103 installed within the case 110.

Elastic members 16 are provided between the cover 11 and the light scanning device 100, to allow the light scanning device 100 to slightly move toward or away from the cover 11 in accordance with opening/closing operations of the cover 11.

The elastic members 16 are installed to exert an elastic force in a direction of moving the cover 11 and the light scanning device 100 away from each other. When the cover 11 closes the body 10, the elastic members 16 become contracted, reducing the distance between the cover 11 and the light scanning device 100. When the cover 11 opens the body 10, as long as no external force acts thereon, the elastic members 16 become restored to increase the distance between the cover 11 and the light scanning device 100.

With the above arrangement, in which the light scanning device 100 and the cover 11 support each other via the elastic members 16, a movement of the light scanning device 100 and the cover 11 in relation to each other may occur, for example, the light scanning device 100 being dropped down relative to the cover 11, which may cause the photosensitive members 31 and the passage windows 104 to become misaligned when the cover 11 closes the body 10.

For this reason, guides 17 are provided at both side surfaces of the case 110 of the light scanning device 100. The guides 17 serve to appropriately position the respective passage windows 104 corresponding to the respective photosensitive members 31 arranged in the body 10 when the cover 11 closes the body 10, thereby allowing laser beams having passed through the passage windows 104 to be accurately scanned to the photosensitive members 31.

Each of the guides 17 is formed at a tip end thereof with a guide hole 18, and the body 10 incorporates a guide rod 10*a* to be engaged with the guide hole 18.

The case 110 of the light scanning device 100 encases a variety of optical parts of the light scanning device 100, to prevent the optical parts from being contaminated by impurities and/or to protect them from shock, etc. The case 110, as shown in FIG. 2, is provided with the passage windows 104. The passage windows 104 correspond in number to the plurality of photosensitive members 31, and are arranged to face the respective photosensitive members 31. Each passage window 104 may have a width corresponding to the length of the photosensitive member 31. Light from the light scanning device 100 is scanned to the photosensitive members 31 through the passage windows 104.

The photosensitive members 31, as shown in FIG. 1, are arranged at an outer circumferential surface of the single intermediate transfer drum 41 with a predetermined interval. If the respective developing units 30Y, 30M, 30C, and 30K are of the same size, right ends of the developing units 30Y, 30M, 30C, and 30K in the drawing (FIG. 1) are not located along a straight vertical line because the outer circumferential surface of the intermediate transfer drum 41 is round.

Specifically, of the four developing units 30Y, 30M, 30C, and 30K, the right ends of two inner developing units 30M and 30C protrude laterally beyond the right ends of two outer developing units 30Y and 30K.

Accordingly, for compact arrangement of the developing device 30 and the light scanning device 100, the light scanning device 100 is formed with a receiving portion 105 recessed from the outer surface of the light scanning device 100, to receive the ends of the two inner developing units 30M and 30C. Correspondingly, portions above and below the receiving portion 105 define protruding portions 106.

The protruding portions 106 are provided with first and fourth passage windows 104*a* and 104*d* corresponding to the photosensitive members 31*a* and 31*d* of the two outer developing units 30Y and 30K. The receiving portion 105 is provided with second and third passage windows 104*b* and 104*c* corresponding to the photosensitive members 31*b* and 31*c* of the two inner developing units 30M and 30C.

Specifically, for compact arrangement of the developing device 30 and the light scanning device 100, the first and fourth passage windows 104*a* and 104*d* and the second and third passage windows 104*b* and 10*c* are located on different planes from each other.

As the light scanning device 100 is supported on the cover 11, the passage windows 104 may become contaminated with debris, etc. attaching to the passage windows 104 or a user may be exposed to the laser beam of the light scanning device 100 when the cover 11 is open.

To address the above, the shutter device 120 operating to close the passage windows 104 of the light scanning device 100 in accordance with opening of the cover 11 is provided.

Figure 3:
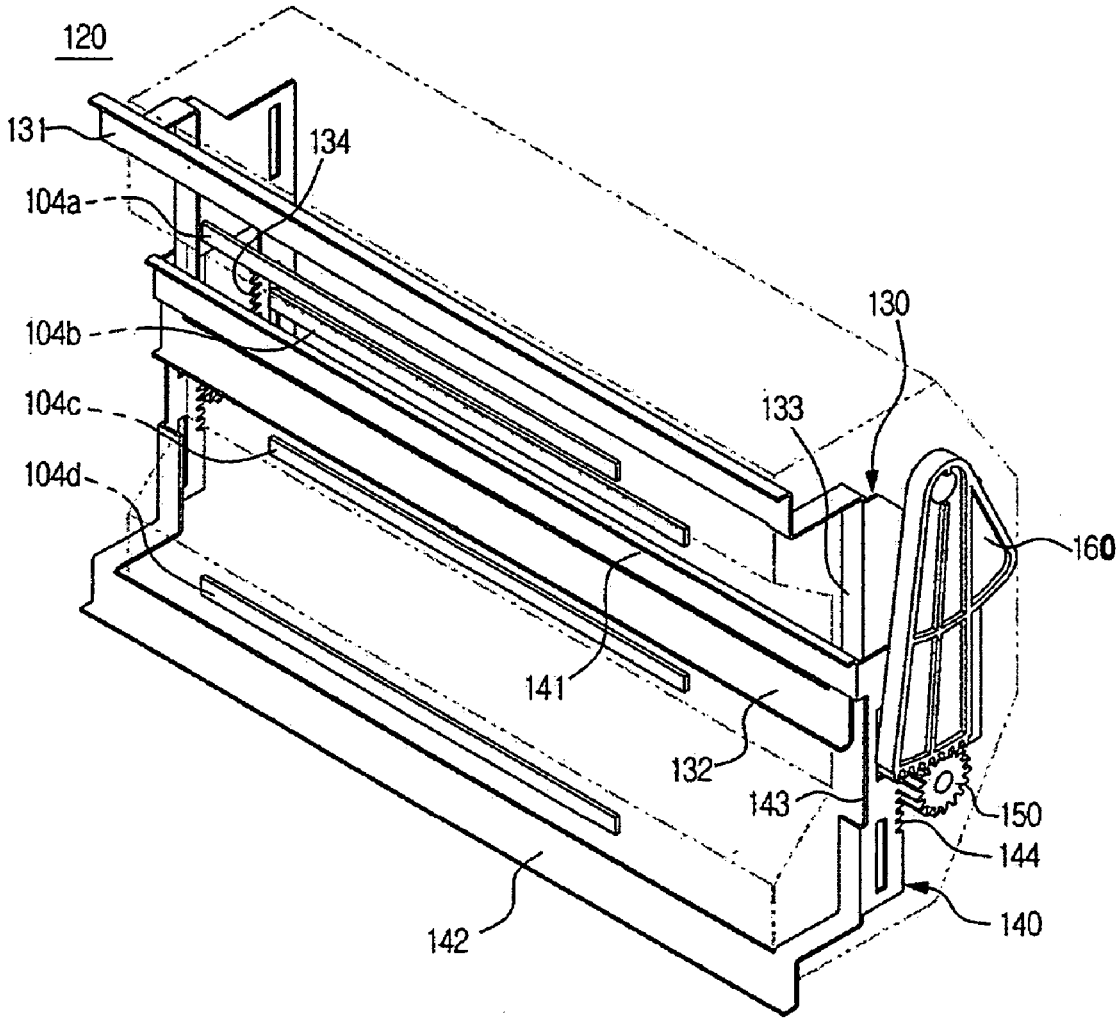
FIG. 3 is a perspective view illustrating a closed state of the cover provided in the image forming apparatus in accordance with the first embodiment of the present invention.
Figure 4:
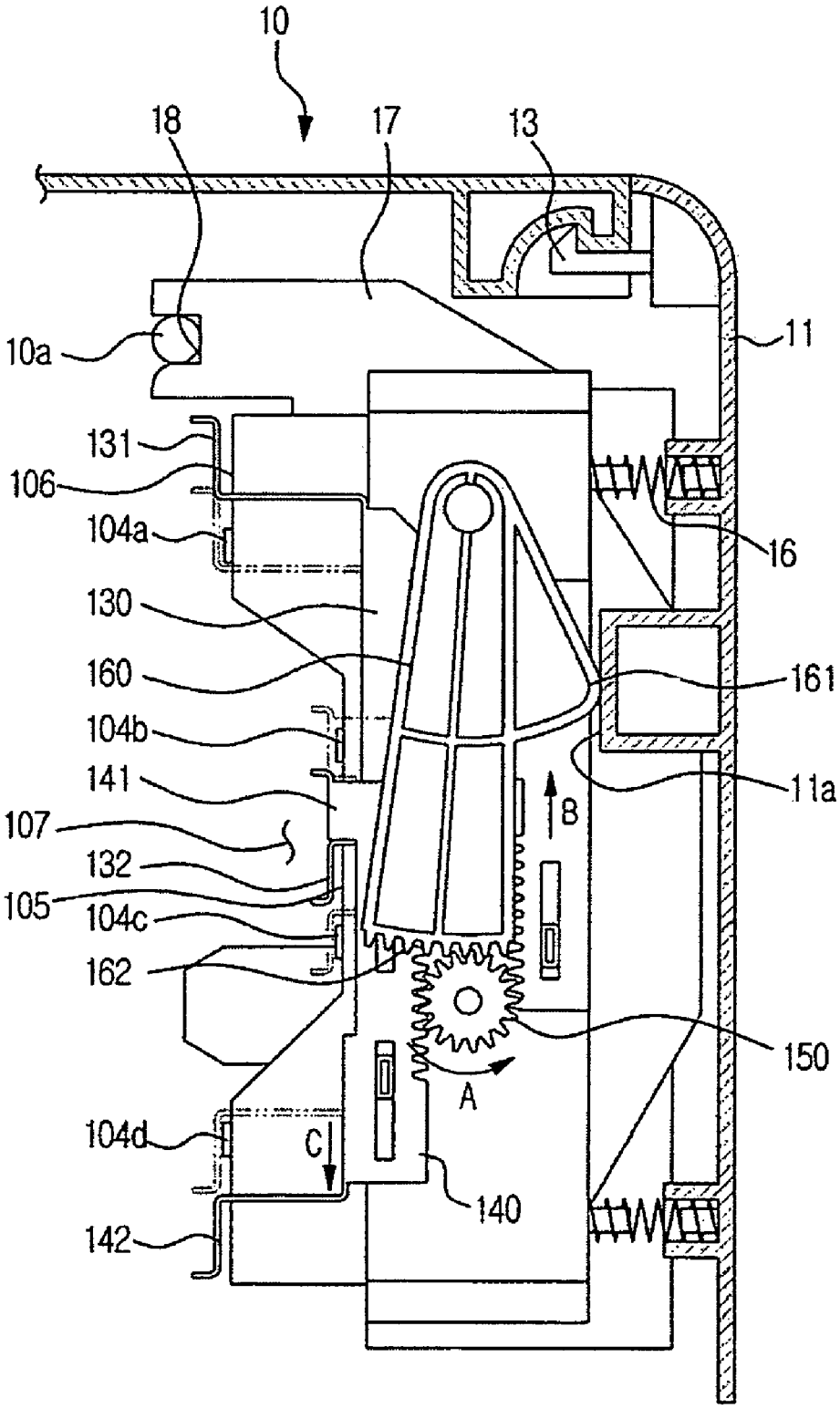
FIG. 4 is a side view illustrating the closed state of the cover provided in the image forming apparatus in accordance with the first embodiment of the present invention.
Figure 5:
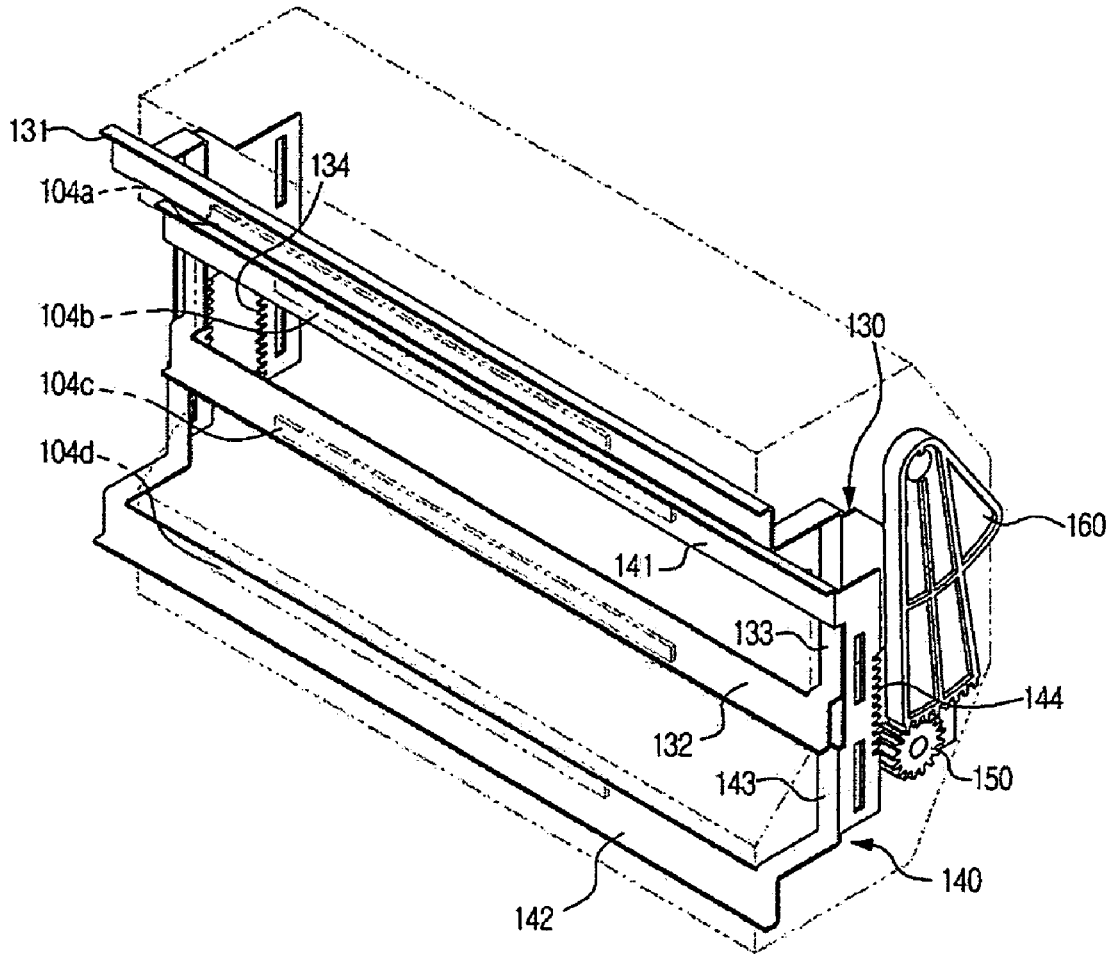
FIG. 5 a perspective view illustrating an opened state of the cover provided in the image forming apparatus in accordance with the first embodiment of the present invention.
Figure 6:
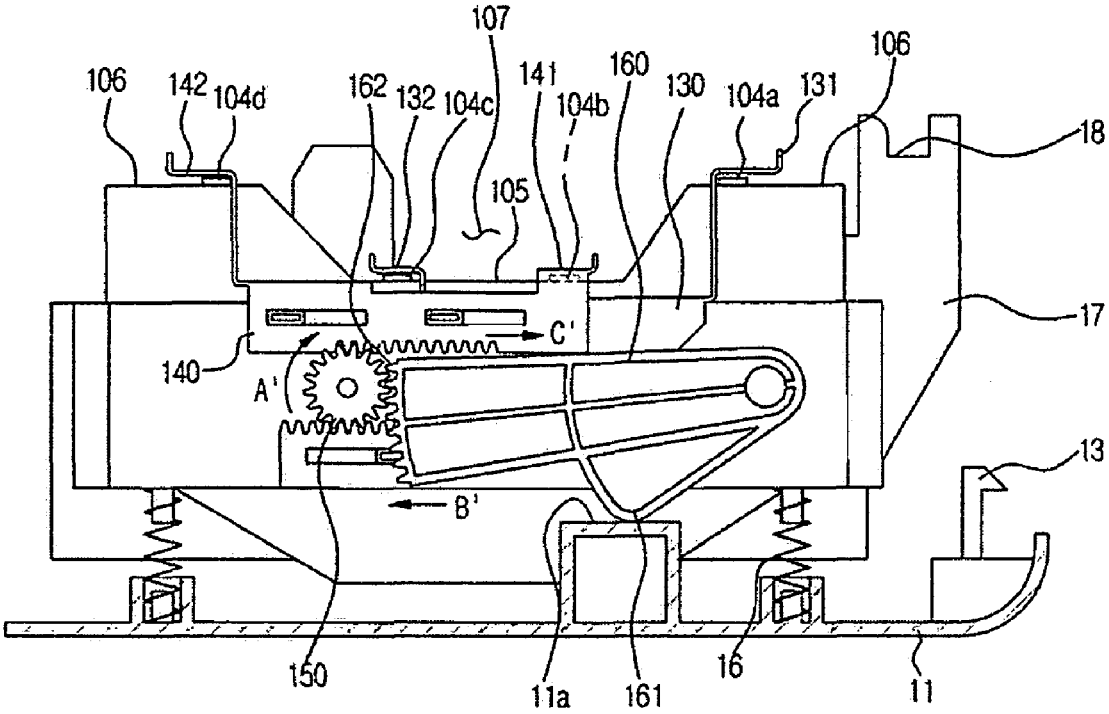
FIG. 6 is a side view illustrating an opened state of the cover provided in the image forming apparatus in accordance with the first embodiment of the present invention.

FIG. 3 is a perspective view illustrating a closed state of the cover provided in the image forming apparatus in accordance with the first embodiment of the present invention. FIG. 4 is a side view illustrating the closed state of the cover provided in the image forming apparatus in accordance with the first embodiment of the present invention. FIG. 5 a perspective view illustrating an opened state of the cover provided in the image forming apparatus in accordance with the first embodiment of the present invention. FIG. 6 is a side view illustrating the opened state of the cover provided in the image forming apparatus in accordance with the first embodiment of the present invention.

The shutter device 120, as shown in FIGS. 3 and 4, is used to open the passage windows 104 upon closing of the cover 11 and to close the passage windows 104 upon opening of the cover 11. The shutter device 120 includes a pair of shutters 130 and 140 formed with shutter plates 131, 132, 141, and 142 corresponding to the plurality of passage windows 104, first gears 150 to rectilinearly reciprocate the shutters 130 and 140 in accordance with opening/closing operations of the cover 11, and levers 160 to rotate the first gears 150 in one direction upon closing of the cover 11 and in the other direction upon opening of the cover 11.

The pair of shutters 130 and 140 are slidable relative to the case 110. Specifically, the first and second shutters 130 and 140 rectilinearly move in different directions in accordance with rotation of the first gears 150.

The first shutter 130 includes first and third shutter plates 131 and 132 to open and to close the first passage window 104*a* provided at the upper protruding portion 106 and the third passage window 104*c* provided at the receiving portion 105, first connectors 133 provided at both sides of the first shutter 130 to connect the first and third shutter plates 131 and 132 to each other, and first racks 134 formed at the first connectors 133 to convert rotating motion of the first gears 150 into rectilinear motion.

To keep the distance between the first passage window 104*a* and the first shutter plate 131 approximately equal to the distance between the third passage window 104*c* and the third shutter plate 132, the first shutter plate 131 protrudes beyond the third shutter plate 132.

The second shutter 140 includes second and fourth shutter plates 141 and 142 to open and to close the second passage window 104*b* provided at the receiving portion 105 and the fourth passage window 104*d* provided at the lower protruding portion 106, second connectors 143 provided at both sides of the second shutter 140 to connect the second and fourth shutter plates 141 and 142 to each other, and second racks 144 formed at the second connectors 143 to convert rotating motion of the first gear 150 into rectilinear motion.

To keep the distance between the second passage window 104*b* and the second shutter plate 141 approximately equal to the distance between the fourth passage window 104*d* and the fourth shutter plate 142, the fourth shutter plate 142 protrudes beyond the second shutter plate 141.

The plurality of shutter plates 131, 132, 141, and 142 are arranged adjacent to the plurality of passage windows 104, respectively, to maintain a predetermined distance therebetween that allows the shutter plates 131, 132, 141, and 142 to slide relative to the case 110 while being arranged adjacent to the passage windows 104.

With the above-described configuration, the ends of the inner developing units 30M and 30C can be received in the space 107 defined in the receiving portion 105 of the case 110. This enables compact arrangement of the developing device 30 and the light scanning device 100, improving space utilization within the body 10.

The first and second racks 134 and 144 are arranged in parallel at positions opposite each other. With the first and second racks 134 and 144, the first and second shutters 130 and 140 slide away from each other while the first gears 150 rotate in one direction, but slide toward each other while the first gears 150 rotate in the other direction.

Each first gear 150 is rotatably fixed to either side surface of the case 110 and is used to transmit a drive force of the lever 160 to the first and second racks 134 and 144.

The lever 160 is pressed upon closing of the cover 11 so as to rotate the first gear 150 in a direction designated by the arrow A as shown in FIG. 4, and is returned upon opening of the cover 11 so as to rotate the first gear 150 in a direction designated by the arrow A' shown in FIG. 6. The lever 160 includes a cam 161 to be moved as it is pressed or returned according to a distance between the cover 11 and the light scanning device 100, and a second gear 162 engaged with the first gear 150 to rotate the first gear 150 in accordance with movement of the cam 161.

With the above-described configuration of the shutter device 120, as shown in FIGS. 3 and 4, upon closing of the cover 11, protrusions 11*a* formed on the rear surface of the cover 11 press the cams 161 of the levers 160 while the elastic members 16 become contracted. As the levers 160 rotate, the second gears 162 rotate simultaneously, causing the first gears 150 to rotate in a direction designated by the arrow A.

Thereby, the first shutter 130, engaged with the first gears 150, slidably move in a direction designated by the arrow B, causing the first and third shutter plates 131 and 132 to open the first and third passage windows 140*a* and 140*c*. Simultaneously, the second shutter 140, engaged with the first gears 150, slidably move in a direction designated by the arrow C, causing the second and third shutter plates 141 and 142 to open the second and fourth passage windows 140*b* and 104*d*.

On the other hand, when the cover 11 is pivotally rotated to open the body 10, as shown in FIGS. 5 and 6, the elastic members 16 between the cover 11 and the light scanning device 100 are restored, and simultaneously, the cams 161 of the levers 160 are returned to rotate the levers 160. As the levers 160 rotate, the second gears 162 rotate in an opposite direction, causing the first gears 150 to rotate in a direction designated by the arrow A'.

Thereby, the first shutter 130, engaged with the first gears 150, slidably move in a direction designated by the arrow B, causing the first and third shutter plates 131 and 132 to open the first and third passage windows 140*a* and 140*c*. Simultaneously, the second shutter 140, engaged with the first gears 150, slidably move in a direction designated by the arrow C, causing the second and fourth shutter plates 141 and 142 to open the second and fourth passage windows 140*b* and 104*d*.

Next, the shutter device to open or close the passage windows of the light scanning device of the image forming apparatus in accordance with a second embodiment of the present invention will be described.

Figure 7:
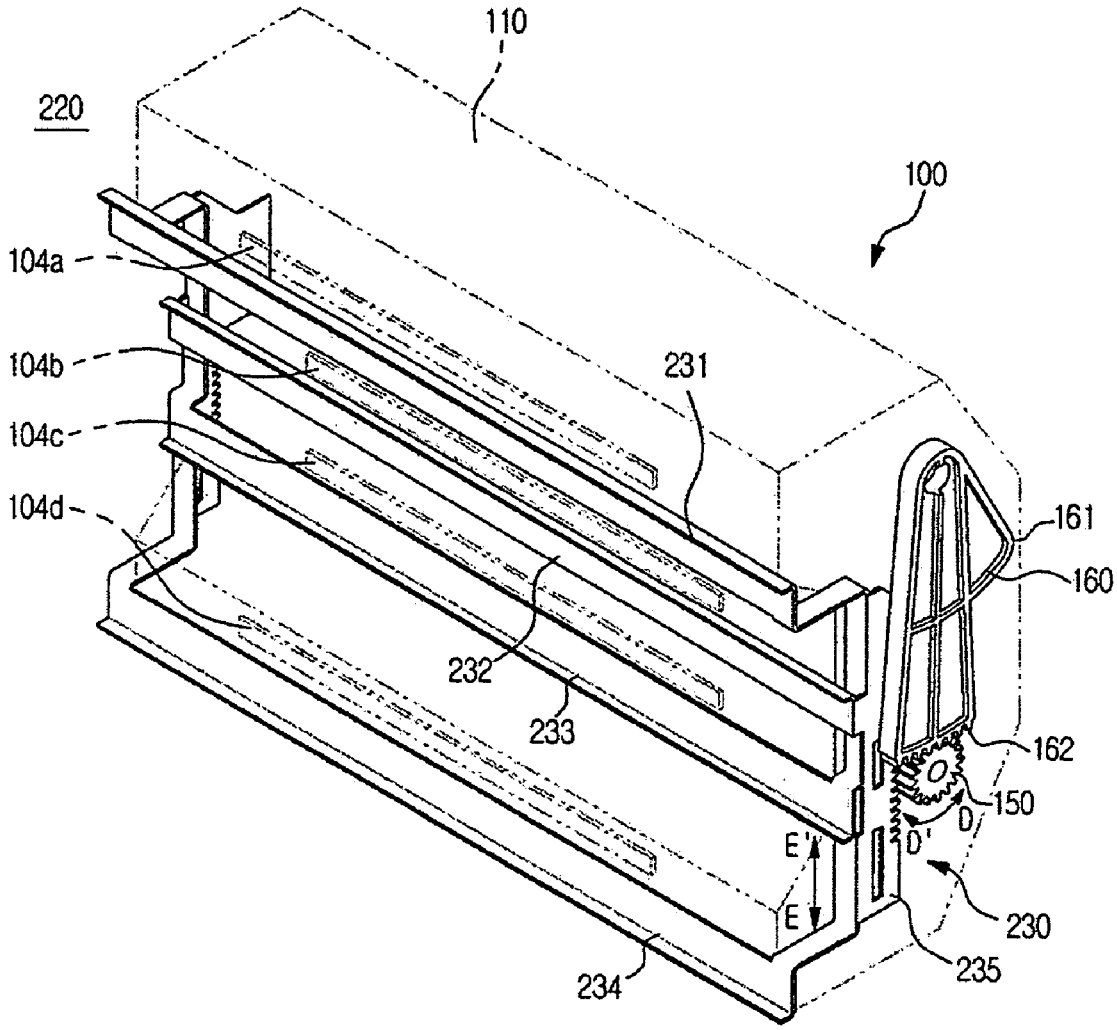
FIG. 7 is a perspective view illustrating operation of a cover provided in an image forming apparatus in accordance with a second embodiment of the present invention.
Figure 8:
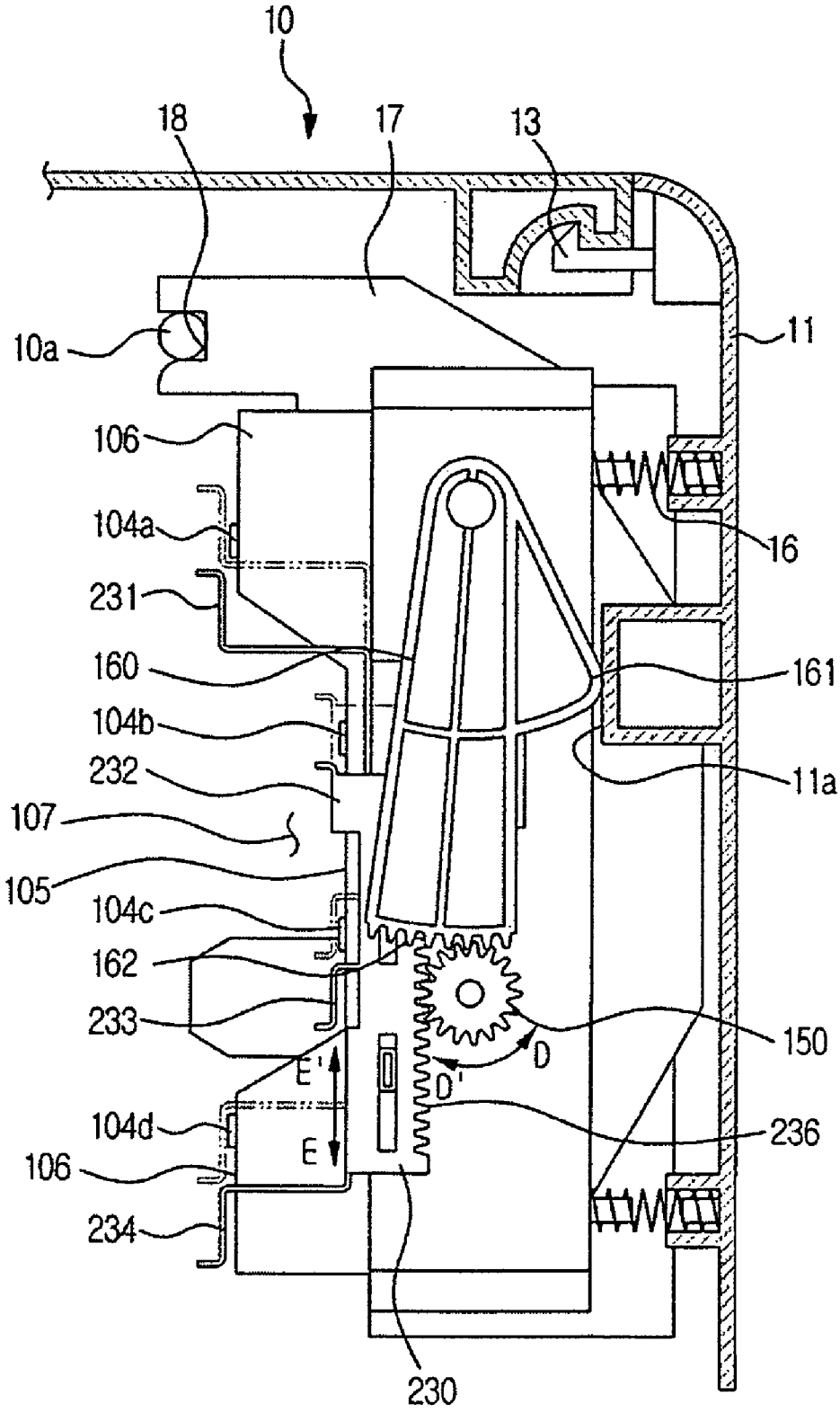
FIG. 8 is a side view illustrating operation of the cover provided in the image forming apparatus in accordance with the second embodiment of the present invention.

FIG. 7 is a perspective view illustrating operation of a cover provided in an image forming apparatus in accordance with a second embodiment of the present invention, and FIG. 8 is a side view illustrating operation of the cover provided in the image forming apparatus in accordance with the second embodiment of the present invention.

The present embodiment is substantially similar to the previously described embodiments, except for the features and configuration of the shutter device to open or close the passage windows of the light scanning device. Thus, the features and configurations that are commonly shared with the previously described embodiments will be designated by the same reference numerals, and the descriptions thereof will not be repeated.

As shown in FIGS. 7 and 8, the shutter device 220 opens the passage windows 104 upon closing of the cover 11, and closes the passage windows 104 upon opening of the cover 11. The shutter device 220 includes a shutter 230 formed with shutter plates 231, 232, 233, and 234 corresponding to the plurality of passage windows 104, the first gears 150 to rectilinearly move the shutter 230 in accordance with opening/closing operations of the cover 11, and the levers 160 to rotate the first gears 150 in one direction upon closing of the cover 11 and in the other direction upon opening of the cover 11.

The shutter 230 has an integral configuration and is slidably coupled to the case 110.

The integral shutter 230 includes first and fourth shutter plates 231 and 234 to open or close the first and fourth passage windows 104*a* and 104*d* provided at the protruding portions 106, second and third shutter plates 232 and 233 to open or close the second and third passage windows 104*b* and 104*c* provided at the receiving portion 105, connectors 235 to connect the respective shutter plates 231, 232, 233, and 234 to one another, and racks 236 formed at the connectors 235 to convert rotating motion of the first gears 150 into rectilinear motion.

To keep the distances between the first and fourth passage windows 104*a* and 104*d* and the first and fourth shutter plates 231 and 234 approximately equal to the distances between the second and third passage windows 104*b* and 104*c* and the second and third shutter plate 232 and 233, the first and fourth shutter plates 231 and 234 protrude beyond the second and third shutter plates 232 and 233.

Accordingly, the shutter plates 231, 232, 233, and 234 are spaced apart from the passage windows 104 by a predetermined distance, and are arranged on two different planes.

With the above-described configuration of the shutter device 220, upon closing of the cover 11, the protrusions 11*a* formed at the rear surface of the cover 11 press the cams 161 of the levers 160 while the elastic members 16 becomes contracted. As the levers 160 rotate, the second gears 162 rotate, causing the first gears 150 to rotate in the direction designated by the arrow D.

Thereby, the shutter 230, engaged with the first gears 150, slidably moves in a direction designated by the arrow E, causing the plurality of shutter plates 231, 232, 233, and 234 to open the plurality of passage windows 140 simultaneously.

On the other hand, when the cover 11 is pivotally rotated to open the body 10, the elastic members 16 between the cover 11 and the light scanning device 100 are restored, and the cams 161 of the levers 160 are returned to rotate the levers 160. As the levers 160 rotate, the second gears 162 rotate in an opposite direction, causing the first gears 150 to rotate in a direction designated by the arrow D'.

Thereby, the shutter 230 engaged with the first gears 150 slidably moves in a direction designated by the arrow E', causing the plurality of shutter plates 231, 232, 233, and 234 to close the plurality of passage windows 104 simultaneously.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a body defining an opening that provides access into the body;

a cover provide to open and close the opening;

a plurality of photosensitive members supported in the body;

a light scanning device to irradiate a light on the plurality of photosensitive members, the light scanning device including a plurality of passage windows each corresponding to a respective one of the plurality of photosensitive members; and a shutter device configured to open and close the plurality of passage windows in accordance with opening and closing of the cover, wherein the shutter device comprises at least one shutter unit including a first plurality of shutter plates, a second plurality of shutter plates and a first gear configured to rotate in a first direction when the cover opens and in a second direction when the cover closes, and each of the first and second plurality of shutter plates is configured to close a respective corresponding one of the plurality of passage windows when the first gear rotates in the first direction, and to open the respective corresponding one of the plurality of passage windows when the first gear rotates in the second direction.

2. The image forming apparatus according to claim 1, wherein the first plurality of shutter plates each being disposed to open and close a corresponding one of a first set of the plurality of passage windows, the second plurality of shutter plates each being disposed to open and close a corresponding one of a second set of the plurality of passage windows, wherein each of the first plurality of shutter plates are arranged on a first common plane, each of the second plurality of shutter plates being arranged on a second common plane different from the first common plane.

3. The image forming apparatus according to claim 2, wherein each of the first set of the plurality of passage windows are arranged on a third common plane proximate to the first common plane, each of the second set of the plurality of passage windows being arranged on a fourth common plane proximate to the second common plane, such distances between respective corresponding ones of the first and second sets of the plurality of passage windows and the first and second plurality of shutter plates are substantially the same.

4. The image forming apparatus according to claim 2, wherein the shutter device further includes a lever configured to rotate in accordance with a movement of the cover, the lever including a cam disposed on a first end of the lever and a second gear disposed on a second end opposite the first end, the cam being configured to be in interfering contact with the cover so as to cause the lever to rotate, the second gear being in engagement with the first gear to cause the first gear to rotate as the lever rotates.

5. The image forming apparatus according to claim 2, wherein the at least one shutter unit includes a rack to convert rotating motion of the first gear into rectilinear motion by which each of the first and second plurality of shutter plates move between a first position to close the respective corresponding one of the plurality of passage windows and a second position opening the respective corresponding one of the plurality of passage windows.

6. The image forming apparatus according to claim 5, wherein the at least one shutter unit comprises a first shutter unit and a second shutter unit moving in opposite directions with respect to each other in accordance with rotation of the first gear, the rack comprising a first rack and a second rack, the first shutter unit comprising the first plurality of shutter plates, a first connector connecting the first plurality of shutter plates with each other, and the first rack disposed on the first connector, the second shutter unit comprising the second plurality of shutter plates, a second connector connecting the second plurality of shutter plates with each other, and the second rack disposed on the second connector.

7. The image forming apparatus according to claim 1, further comprising: an elastic member provided between the cover and the light scanning device, the elastic member being configured to elastically bias the light scanning device to move away from the cover.

8. The apparatus according to claim 7 wherein the light scanning device further includes a guide to adjust a position of the light scanning device relative to the body when the cover is closed.

9. A single-path type image forming apparatus including a body defining an external appearance of the image forming apparatus, a cover to open and close an opening formed on the body; and a plurality of photosensitive members supported in the body, the single-path type image forming apparatus further comprising:

a light scanning device having a plurality of passage windows each providing an optical path of light from the light scanning device to a respective corresponding one of the plurality of photosensitive members, the plurality of passage windows being arranged on at least two planes; and a shutter device including a plurality of shutter plates configured to open and close the plurality of passage windows, the plurality of shutter plates including a first plurality of shutter plates arranged on a first common plane, and second plurality of shutter plates arranged on a second common plane different from the first common plane.

10. The single-path type image forming apparatus according to claim 9, wherein the predetermined distance for each pair of corresponding ones of the plurality of shutter plates and the plurality of passage windows being substantially the same.

11. The single-path type image forming apparatus according to claim 9, wherein the shutter device comprises a first gear configured to rotate in a first direction when the cover opens and in a second direction when the cover closes, and wherein each of the plurality of shutter plates is configured to close a respective corresponding one of the plurality of passage windows when the first gear rotates in the first direction, and to open the respective corresponding one of the plurality of passage windows when the first gear rotates in the second direction.

12. The single-path type image forming apparatus according to claim 11, wherein the shutter device further includes a lever configured to rotate in accordance with a movement of the cover, the lever including a cam disposed on a first end of the lever and a second gear disposed on a second end opposite the first end, the cam being configured to be in interfering contact with the cover so as to cause the lever to rotate, the second gear being in engagement with the first gear to cause the first gear to rotate as the lever rotates.

13. The single-path type image forming apparatus according to claim 12, wherein the shutter device further comprises a rack to convert rotating motion of the first gear into rectilinear motion by which each of the plurality of shutter plates move between a first position to close the respective corresponding one of the plurality of passage windows and a second position opening the respective corresponding one of the plurality of passage windows.

14. The single-path type image forming apparatus according to claim 13, wherein the shutter device comprises a first shutter unit and a second shutter unit configured to move in opposite directions with respect to each other in accordance with rotation of the first gear, the rack comprising a first rack and a second rack, the first shutter unit comprising the first plurality of shutter plates, a first connector connecting the first plurality of shutter plates with each other, and the first rack disposed on the first connector, the second shutter unit comprising the second plurality of shutter plates, a second connector connecting the second plurality of shutter plates with each other, and the second rack disposed on the second connector.

15. The single-path type image forming apparatus according to claim 14, further comprising: an elastic member provided between the cover and the light scanning device, the elastic member being configured to elastically bias the light scanning device to move away from the cover.

16. A single-path type image forming apparatus including a body; a cover hingedly coupled to the body to via pivotal rotation thereof open and close an opening defined by the body; and a plurality of photosensitive members provided in the body, the single-path type image forming apparatus comprising:

a shutter device having a plurality of passage windows corresponding to the plurality of photosensitive members, the plurality of passage windows being arranged on at least two planes, and a plurality of shutters each arranged adjacent to a respective corresponding one of the plurality of passage windows, wherein each of the plurality of shutters include a first plurality of shutter plates arranged on a first common plane and a second plurality of shutter plates arranged on a second common plane different from the first common plane wherein each of the first and second plurality of shutters of the shutter device are configured to selectively open and close the respective corresponding one of the plurality of passage windows in accordance with a movement of the cover in opening and closing the opening.

17. The single-path type image forming apparatus according to claim 16, wherein the shutter device comprises a first gear configured to rotate in a first direction when the cover opens and in a second direction when the cover closes, and wherein each of the plurality of shutters is configured to close the respective corresponding one of the plurality of passage windows when the first gear rotates in the first direction, and to open the respective corresponding one of the plurality of passage windows when the first gear rotates in the second direction.

18. The single-path type image forming apparatus according to claim 17, wherein the shutter device further includes a lever configured to rotate in accordance with the movement of the cover, the lever including a cam disposed on a first end of the lever and a second gear disposed on a second end opposite the first end, the cam being configured to be in interfering contact with the cover so as to cause the lever to rotate according to the movement of the cover, the second gear being in engagement with the first gear to cause the first gear to rotate as the lever rotates, and wherein the shutter device further comprises a rack to convert rotating motion of the first gear into rectilinear motion by which each of the plurality of shutters move between a first position to close the respective corresponding one of the plurality of passage windows and a second position opening the respective corresponding one of the plurality of passage windows.

19. A single-path type image forming apparatus including a body to support a plurality of photosensitive members and a cover to open and close an opening formed on the body; and the image forming apparatus comprising:

a light scanning device having a plurality of passage windows to pass light therethrough and stimulate a corresponding photosensitive member among the plurality of photosensitive members;

a shutter device including a plurality of shutter plates to close and open the plurality of passage windows; and an actuation unit including an actuator coupled to the cover and a gear rotatably coupled to the actuator and the shutter device to rotate in a first direction when the cover opens and to rotate in a second direction when the cover closes, wherein each of the plurality of shutter plates closes a respective corresponding passage window in response to rotating the in the first direction, and opens the respective corresponding passage window in response to rotating the gear in the second direction.

* * * * *